US009805637B2

(12) United States Patent
Huang et al.

(10) Patent No.: US 9,805,637 B2
(45) Date of Patent: Oct. 31, 2017

(54) DISPLAY DEVICES FOR COMPENSATING FOR KICKBACK-VOLTAGE EFFECT

(71) Applicant: InnoLux Corporation, Miao-Li County (TW)

(72) Inventors: Sheng-Feng Huang, Miao-Li County (TW); Cheng-Hsiao Lin, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 11 days.

(21) Appl. No.: 14/926,634

(22) Filed: Oct. 29, 2015

(65) Prior Publication Data

US 2016/0125783 A1 May 5, 2016

(30) Foreign Application Priority Data

Nov. 5, 2014 (TW) ..... 103138312 A

(51) Int. Cl.

*G09G 3/30* (2006.01)
*G09G 3/36* (2006.01)
*G09G 3/20* (2006.01)

(52) U.S. Cl.

CPC ... *G09G 3/2003* (2013.01); *G09G 2300/0426* (2013.01); *G09G 2300/0452* (2013.01); *G09G 2310/0235* (2013.01); *G09G 2310/0267* (2013.01); *G09G 2310/0275* (2013.01); *G09G 2310/08* (2013.01); *G09G 2320/0233* (2013.01); *G09G 2320/0242* (2013.01)

(58) Field of Classification Search

CPC ..... G09G 3/3275–3/3291
See application file for complete search history.

(56) References Cited

U.S. PATENT DOCUMENTS

2014/0333676 A1* 11/2014 Fujii ..... G09G 3/2003 345/690
2015/0035734 A1* 2/2015 Lee ..... G09G 3/3258 345/76

* cited by examiner

*Primary Examiner* — Sanghyuk Park
(74) *Attorney, Agent, or Firm* — McClure, Qualey & Rodack, LLP

(57) ABSTRACT

A display device is provided. In the display device, sub-pixels are coupled to scan lines and data lines. On the same scan line, the sub-pixels with a predetermined number are belonged into a pixel group. For two pixel groups coupled to the same data lines and respectively coupled to two adjacent scan lines, two sub-pixels, which are respectively belonged into the two pixel groups and successively receive the corresponding data signals in time, receive the same one of the various color information. For each pixel group, in each display period, the enable states of the clock signals have a plurality of combinations having a specific number, the specific number is $2\times C^{K}_{2}$, where C represents two clock signals are selected from the clock signal having the predetermined number, and K is a positive integer.

10 Claims, 9 Drawing Sheets

DISPLAY DEVICES FOR COMPENSATING FOR KICKBACK-VOLTAGE EFFECT

CROSS REFERENCE TO RELATED APPLICATIONS

This Application claims priority of Taiwan Patent Application No. 103138312, filed on Nov. 5, 2014, the entirety of which is incorporated by reference herein.

BACKGROUND OF THE INVENTION

Field of the Invention

The invention relates to a display device, and more particularly to a display device capable of compensate for kickback-voltage effect induced by clock signals.

Description of the Related Art

Generally, low temperature poly-silicon (LTPS) display panels have higher mobility. Thus, LTPS display panels have fast response speed, high brightness, high resolution, low power consumption, and other benefits. Among driving methods for LTPS display panels, a time-division driving method called a de-multiplexer (DEMUX) is adopted to decrease the number of input/output pins of source drivers. For example, for an LTPS display device which adopts a 1:3 DEMUX driving method and has high resolution (such as 1080×RGB×120), each control clock signal has loading of 1080 switches. At this time, the consumed power is proportional to $C \times V^2 \times F$, wherein C represents parasitical capacitance which is determined by switch size (W×L), V represents the voltage swing of the corresponding control clock signal, and F represents the frequency of the corresponding control clock signal.

With the development tendency of electronic devices, how to minimum consumed power is an important issue. For an electronic device using an LTPS display panel, the whole power consumption of the can be reduced by reducing the power consumption induced by a DEMUX driving method. According to the above description, by decreasing the values of C, V, and/or F, the power consumption of the LTPS display panel can be reduced. In current techniques, the power consumption can be reduced by decreasing the frequency of the control clock signal of the DEMUX driving method. However, in these techniques, kickback-voltage effect induced by switches may cause non-uniform image colors displayed on the LTPS panels.

BRIEF SUMMARY OF THE INVENTION

An exemplary embodiment of a display device operating in a plurality of display period is provided. The display device comprises a plurality of scan lines, a plurality of data lines, a plurality of sub-pixels, and a plurality of clock signals. The data lines are interlaced with the scan lines and transmit a plurality of data signals. Each data signal has various color information. The sub-pixels are coupled to the scan lines and the data lines. Each sub-pixel corresponds to one color information. The clock signals correspond to the sub-pixels respectively. On the same scan line, the sub-pixels with a predetermined number are belonged into a pixel group, the sub-pixels of each pixel group receives one of the data signals according to enable states of the clock signals with the predetermined number, respectively. For two pixel groups coupled to the same data lines and respectively coupled to two adjacent scan lines, the two pixel groups receive one of the data signals through the corresponding data lines successively, two sub-pixels, which are respectively belonged into the two pixel groups and successively receive the corresponding data signals in time, receive the same one of the various color information. For each pixel group, in each display period, the enable states of the clock signals have a plurality of combinations having a specific number, the specific number is $2 \times C_2^K$ where $C_2^K$ represents the number of combinations for any two clock signals selected from the clock signals having the predetermined number, and K is a positive integer. The combinations having the specific number at least comprise a first combination and a second combination following the first combination, an enable order of the clock signals in the second combination is inverse to an enable order of the clock signals in the first combination.

Another exemplary embodiment of a display device operating in a plurality of display period is provided. The display device comprises a plurality of scan lines, a plurality of data lines, a plurality of sub-pixels, and a plurality of clock signals. The data lines are interlaced with the scan lines and transmit a plurality of data signals. Each data signal has various color information. The sub-pixels are coupled to the scan lines and the data lines. Each sub-pixel corresponds to one color information. The clock signals correspond to the sub-pixels respectively. On the same scan line, the sub-pixels having a predetermined number are belonged into a pixel group, the sub-pixels of each pixel group receives one of the data signals according to enable states of the clock signals with the predetermined number, respectively. For two pixel groups coupled to the same data lines and respectively coupled to two adjacent scan lines, the two pixel groups receive one of the data signals through the corresponding data lines successively, two sub-pixels, which are respectively belonged into the two pixel groups and successively receive the corresponding data signals in time, receive the same one of the various color information. For two pixel groups coupled to the same data lines and respectively coupled to two adjacent scan lines, in each display period, the numbers of kickback-voltage effect induced by the corresponding clock signals are equal. The combinations with the specific number at least comprise a first combination and a second combination following the first combination, an enable order of the clock signals in the second combination is inverse to an enable order of the clock signals in the first combination.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
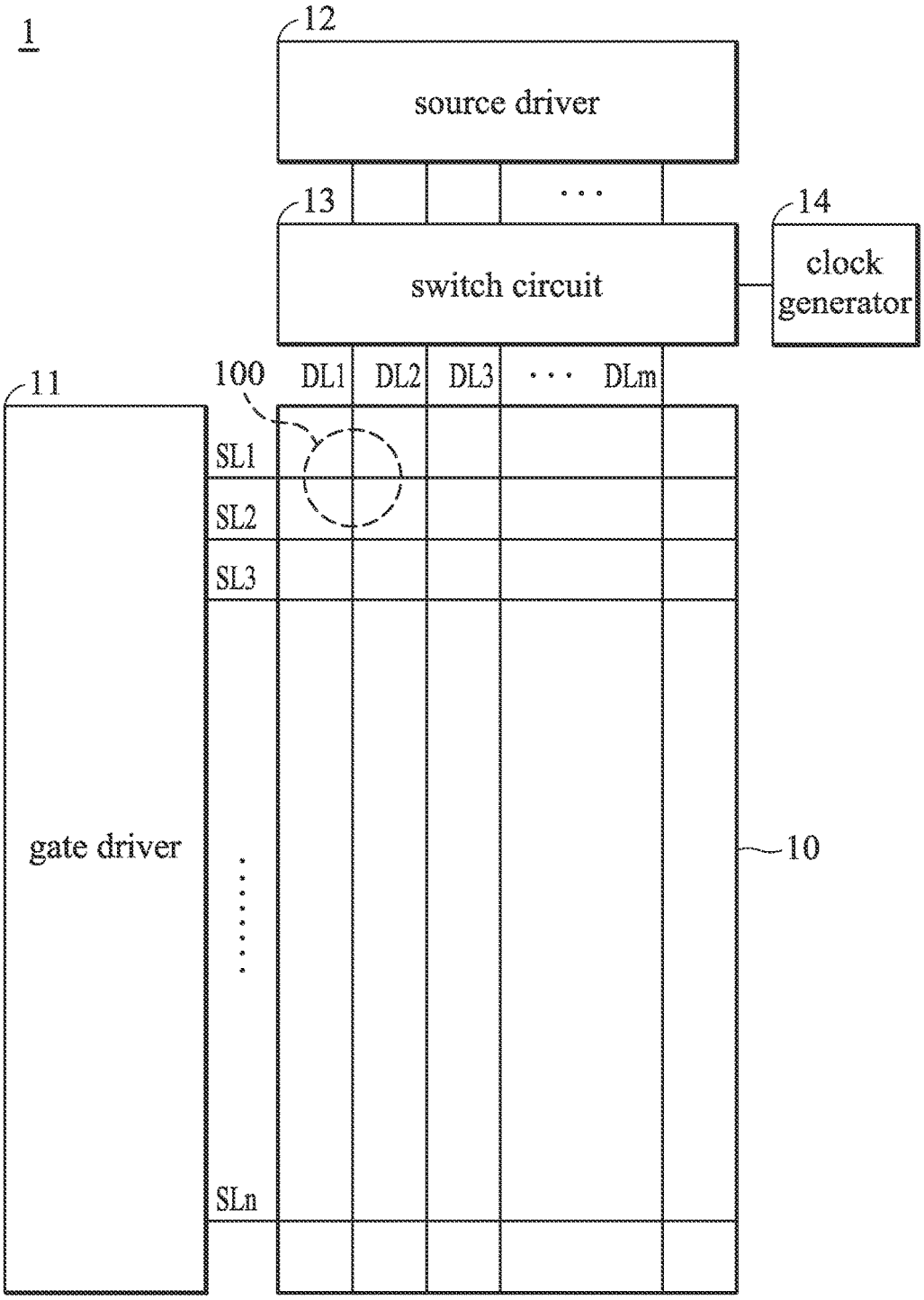
FIG. 1 shows an exemplary embodiment of a display device.

The following description is of the contemplated mode of carrying out the invention. This description is made for the purpose of illustrating the general principles of the invention and should not be taken in a limiting sense. The scope of the invention is determined by reference to the appended claims.

Display devices are provided. In an exemplary embodiment of a display device in FIG. 1, a display device 1 operates in a plurality of successive display periods and comprises a display array 10, gate driver 11, a source driver 12, a switch circuit 13, a clock generator 14, data lines DL1~DLm, and scan lines SL1~SLn. The scan lines SL1~SLn are disposed successively, and each scan line extends along the horizontal direction. The data lines DL1~DLn are disposed successively, and each data externs along the vertical direction. The scan lines SL1~SLn are interlaced with the data lines DL1~DLm, and each set of the interlaced scan line and data line corresponding one sub-pixel. For example, the interlaced scan line SL1 and data line DL1 corresponds to a sub-pixel 100. According to the disposition relationship between the scan lines SL1~SLn, the data line DL1~DLm, and the corresponding sub-pixels, a plurality of sub-pixels 100 are disposed on a plurality of rows and a plurality of columns to form the display array 10. The gate driver 11 is coupled to the scan lines SL1~SLn and drives the scan lines SL1~SLn successively. The source drive 12 is coupled to the data lines DL1~DLm and transmits data signals to the switch circuit 13. The clock generator 14 generates a plurality of clock signals to the switch circuit 13, such that the switch circuit 13 transmits the received data signals to the corresponding sub-pixel 100 through the data lines DL1~DLm according to the enabling states of the clock signals. The switch circuit 13 comprises a plurality of switch units. The structure and operation of the switch units of the switch circuit 13 is described in the following.

Figure 2:
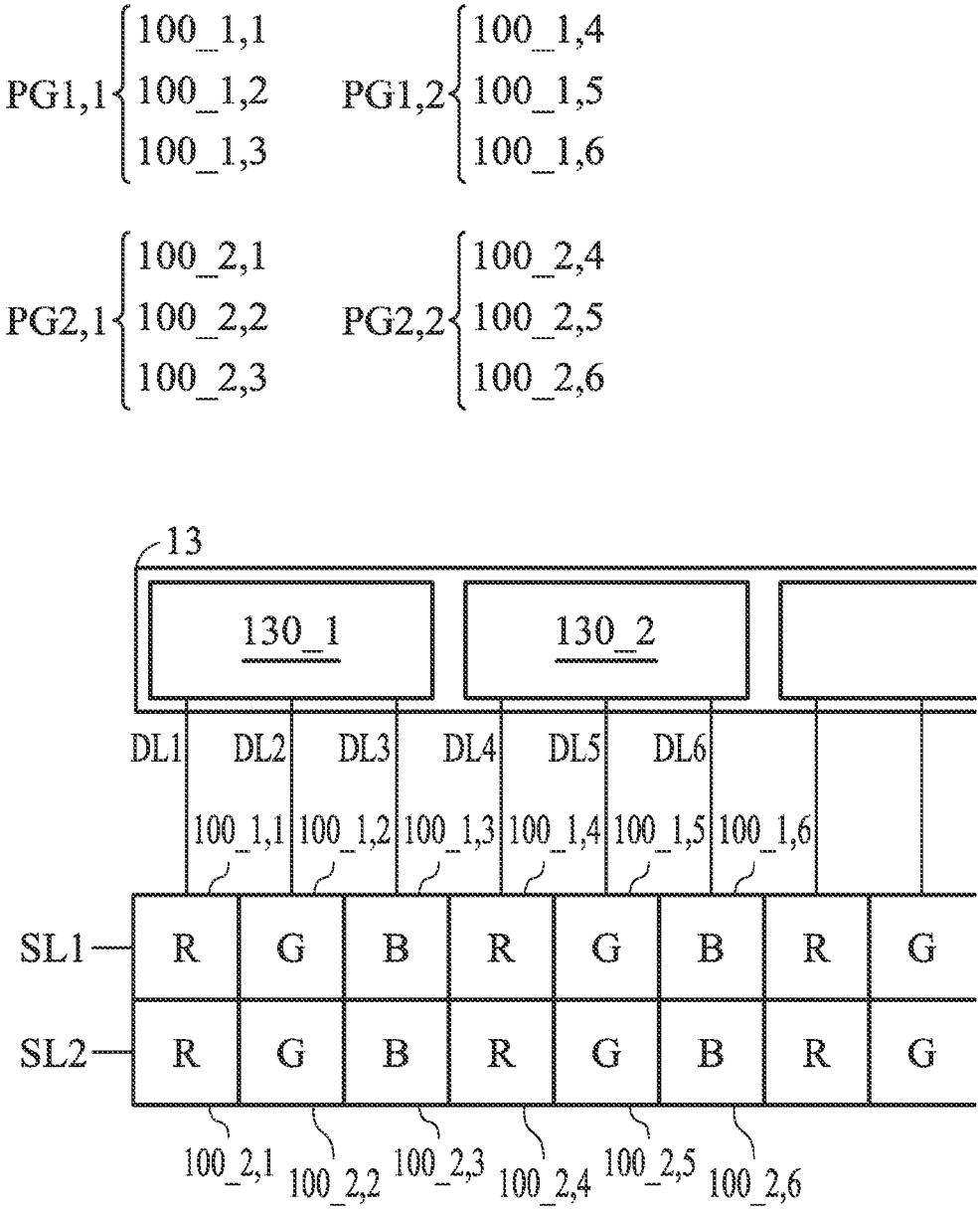
FIG. 2 shows one exemplary embodiment of switch units and pixel groups.

In the embodiment, among sub-pixels which are coupled to the same scan line, the sub-pixels with a predetermined number (K) are belonged/grouped into one pixel group. In the following, three sub-pixels (K=3) being belonged/groups into one pixel group are given as an example for illustrating the operation of the switch circuit 13. Referring to FIG. 2, for the scan line SL1, the first three sub-pixels 100_1,1, 100_1,2, and 100_1,3 are belonged into a pixel group PG1,1; the following three sub-pixels 100_1,4, 100_1,5, and 100_1,6 are belonged into a pixel group PG1,2; and the other sub-pixels are belonged into the corresponding pixel groups by the same manner. For the line SL2, the first three sub-pixels 100_2,1, 100_2,2, and 100_2,3 are belonged into a pixel group PG2,1; the following three sub-pixels 100_2,4, 100_2,5, and 100_2,6 are belonged into a pixel group PG2,2; and the other sub-pixels are belonged into the corresponding pixel groups by the same manner. For illustrating the relationship between the sub-pixels and pixel groups, FIG. 2 only shows the sub-pixels and the pixel groups on the scan lines SL1 and SL2. The relationship between the sub-pixels and the pixel groups on the scan lines SL3~SLn is the same as that on the scans SL1 and SL2, and the related description is thus omitted. Referring to FIG. 2, the pixel groups PG1,1 and PG2,1 are coupled to the same data lines DL1~DL3, and the pixel groups PG1,2 and PG2,2 are coupled to the same data lines DL4~DL6.

In the embodiment, the number of switch units in the switch circuit 13 is determined the number of pixel groups on the same scan line. In detailed, the number of switch units in the switch circuit 13 is equal to the number of pixel groups on the same scan line. Accordingly, the pixel groups which are coupled to the same scan line are coupled to different switch units, and the two pixel groups which are coupled to two adjacent scan lines and the same data line are coupled to the same switch unit. For example, the pixel groups PG1,1 and PG1,2 which are coupled to the scan line SL1 are coupled to switch units 130_1 and 130_2 respectively, and the pixel groups PG2,1 and PG2,2 which are coupled to the scan line SL2 are coupled to switch units 130_1 and 130_2 respectively. Moreover, the pixel groups PG1,1 and PG2,1 are controlled by the same switch unit 130_1, and the pixel groups PG1,2 and PG2,2 are controlled by the same switch unit 130_2.

In the embodiment of FIG. 2, the three sub-pixels in each pixel group correspond to different color information. For example, the three sub-pixels in each pixel group correspond to red (R), green (G), and blue (B) information respectively. In each pixel group, the sub-pixels respectively corresponding to the red (R), green (G), and blue (B) information are disposed by a specific pattern. As shown in FIG. 2, in each of the pixel groups PG1,1, PG2,1, PG1,2, and PG2,2, the sub-pixels respectively corresponding to the red (R), green (G), and blue (B) information are disposed successively.

Figure 3:
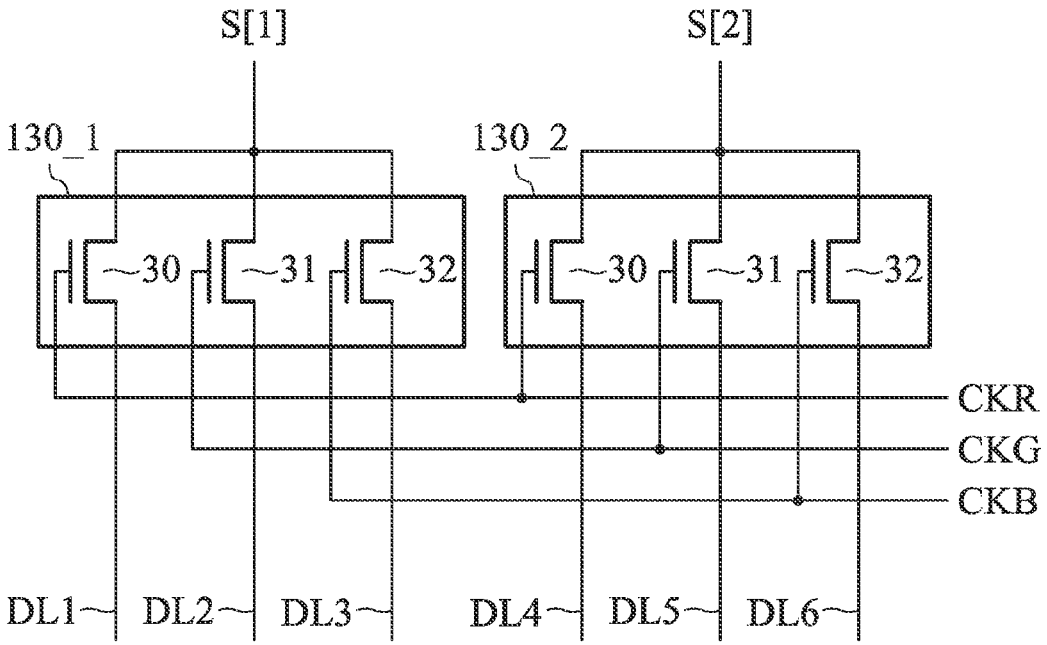
FIG. 3 shows one exemplary embodiment of a circuit structure of a switch circuit.

The display array 10 is driven by a time-division driving method called a de-multiplexer (DEMUX) driving method. Thus, the number (K) of clock signals generated by the clock generator 14 is determined according to the number of sub-pixels in each pixel group. In the embodiment of FIG. 1, the number of clock signals generated by the clock generator 14 is equal to the number of sub-pixels in each pixel group, that is the clock generator 14 generates three clock signals CKR, CLRG, and CKB (K=3) for controlling each switch unit. FIG. 3 shows an exemplary embodiment of each switch unit. Referring to FIG. 3, each switch unit comprises three switches 30, 31, and 32 to accomplish the 1:3 DEMUX driving method. Gates of the switches 30, 31, and 32 receive the clock signals CKR, CKG, and CKB respectively. Drains of the switches 30, 31, and 32 are coupled to the source driver 12. Source of the switches 30, 31, and 32 are coupled to the corresponding data lines respectively. For example, for the switches 30, 31, and 32 of the switch unit 130_1, the gates receive the clock signals CKR, CKG, and CKB respectively, the drains thereof are coupled to the drain driver 12 to receive a data signal S[1], and the sources thereof are coupled to the data lines DL1~DL3 respectively. The other switch units have the same circuitry structure as the switch unit 130_1, and the related description is thus omitted. When one clock signal is at an enable state, the corresponding switch is turned on to transmit the corresponding color information in the data signal to the corresponding data line. For example, for the switch unit 130_1, when the clock signal CKR is at the enable state, the switch 30 is turned on to transmit the red information in the data signal S[1] to the data line DL1; when the clock signal CKG is at the enable state, the switch 31 is turned on to transmit the green information in the data signal S[1] to the data line DL2; when the clock signal CKB is at the enable state, the switch 32 is turned on to transmit the blue information in the data signal S[1] to the data line DL3. The operation and the relationship between the clock signals and transmission of the color information of the other switch units are the same as these of the switch unit 130_1.

The display device 1 of the embodiment operates in a plurality of display periods. In an embodiment, each display period comprises a plurality of frame periods, and the number of frame period in each display period is determined according to the number of combinations of the enable states of the clock signals for one pixel group in the display period. In another embodiment, for each pixel group, in each display period, the number of combinations of the enable states of the clock signals is equal to $2\times C_2^K$($X=2\times C_2^K$), wherein the term "$_2^K$" of $2\times C_2^K$ represents selecting two clock signals among the K clock signals. In the embodiment of FIGS. 2 and 3, for each pixel group, in each display period, the number of combinations of the enable states of the clock signals CKR, CKG, and CKB is equal to 6 (X=6). Thus, each display period comprises six frame periods. For each pixel group, the six combinations of the enable states of the clock signals CKR, CKG, and CKB appear in the six frame periods of one display period respectively.

FIGS. 4A~4F shows an exemplary embodiment of the six combinations of the enable states of the clock signals CKR, CKG, and CKB in the six frame periods in one display period. In the following, the pixel groups PG1,1 and PG2,1, the clock signal CKR, CKG, and CKB, and the corresponding color information are given as an example for illustrating the six combination of the enable states of the clock signal in one display period. In FIGS. 4A~4F, PLS1 represents the timing when the pixel group PG1,1 receives the data signal S[1]. That is, in the enable period of PLS1, the switches 30~32 of the switch unit 130_1 are turned on to transmit the red, green, and blue information of the data signal S[1] to the sub-pixels 100_1,1, 100_1,2, and 100_1,3 through the data lines DL1, DL2, and DL3, respectively. In FIGS. 4A~4F, PLS2 represents the timing when the pixel group PG2,1 receives the data signal S[1]. That is, in the enable period of PLS2, the switches 30~32 of the switch unit 130_1 are turned on to transmit the red, green, and blue information of the data signal S[1] to the sub-pixels 100_2,1, 100_2,2, and 100_2,3 through the data lines DL1, DL2, and DL3, respectively.

Figure 4A:
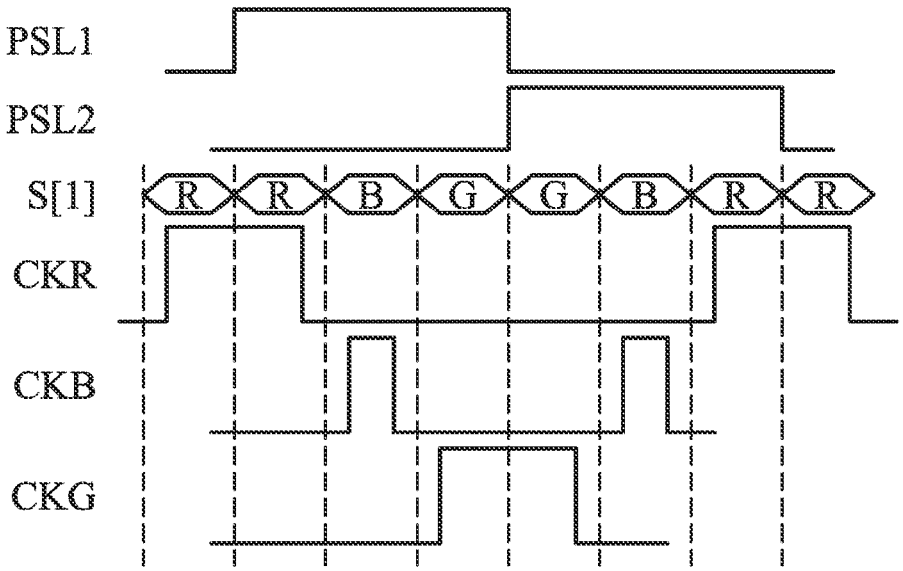
FIGS. 4A-4F show one exemplary embodiment of combinations of enable states of clock signals in the several frame periods.
Figure 4B:
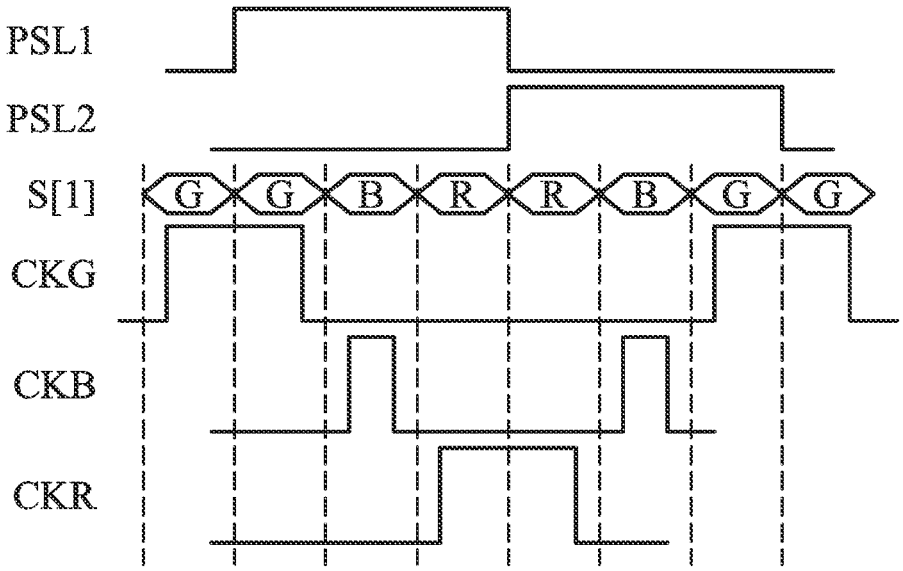
Figure 4C:
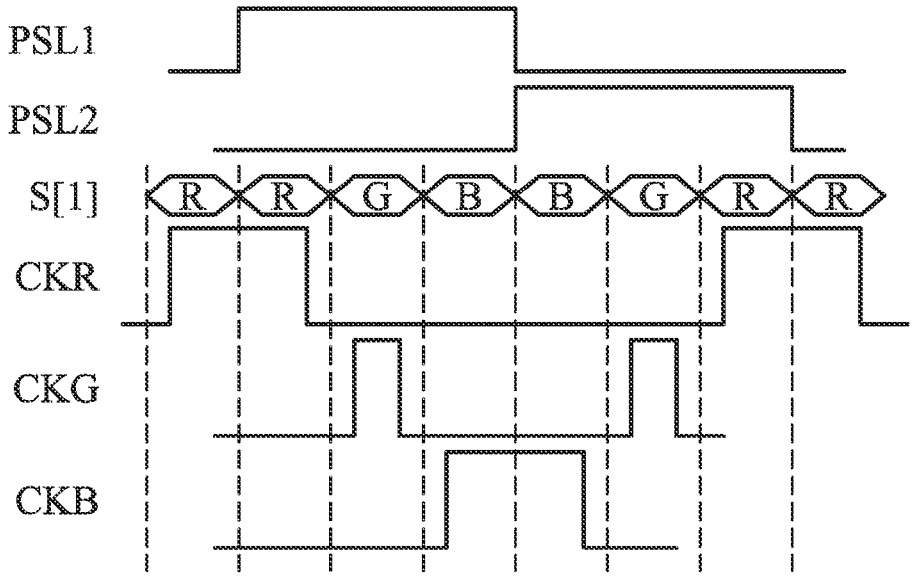
Figure 4D:
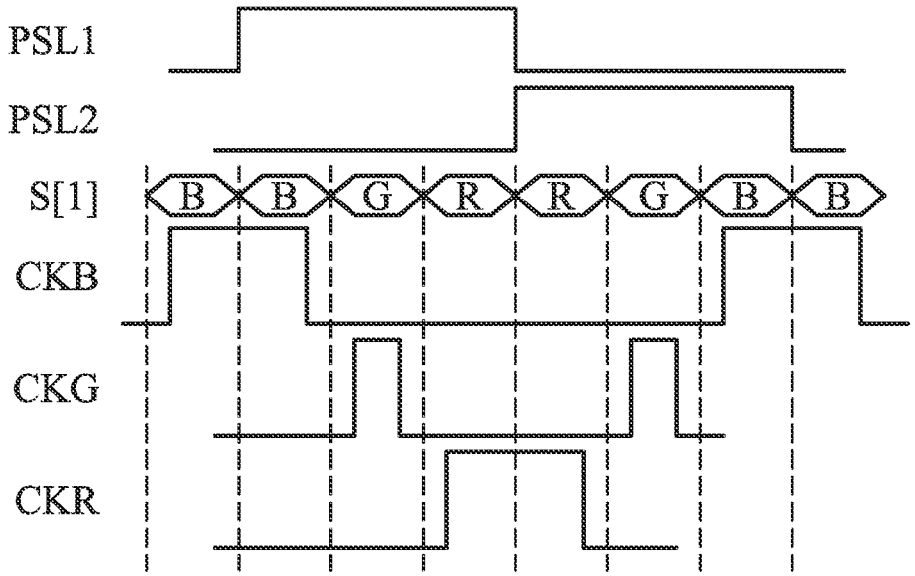
Figure 4E:
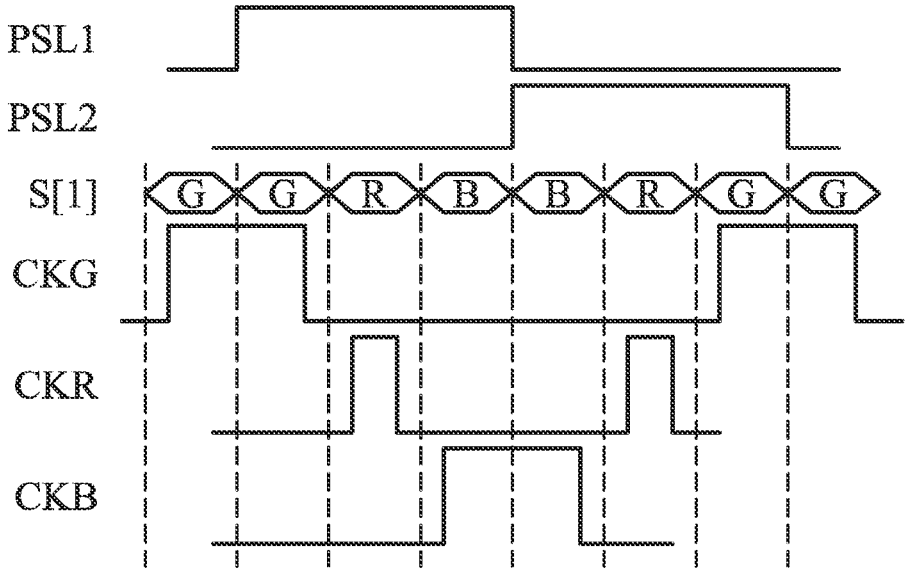
Figure 4F:
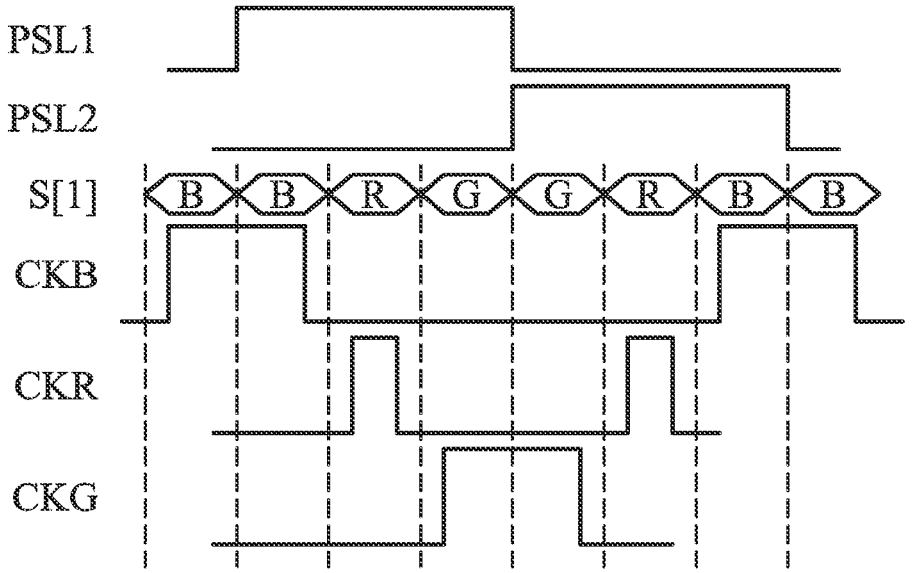

Referring to FIG. 4A, for the first frame period of the display period, in the enable period of PSL1, the clock signals CKR, CKB, and CKG state at the enable states successively (the first combination of the enable states for the pixel group PG1,1), the enable states of the clock signals CKR, CKB, and CKG do not overlap. At this time, the red (R), blue (B), and green (G) information of the data signal S[1] are successively provided to the sub-pixels 100_1,1, 100_1,3, and 100_1,2 in time. Referring to FIG. 4B, for the second frame period of the display period, in the enable period of PSL1, the clock signals CKG, CKB, and CKR state at the enable states successively (the second combination of the enable states for the pixel group PG1,1), the enable states of the clock signals CKG, CKB, and CKR do not overlap. At this time, the green (G), blue (B), and red (R) information of the data signal S[1] are successively provided to the sub-pixels 100_1,2, 100_1,3, and 100_1,1 in time. Similarly, referring to FIGS. 4C~4F represent, for the pixel group PG1,1, the third, fourth, fifth, and sixth combinations of the enable states of the clock signals in the third, fourth, fifth, and sixth frame periods of the display period.

Referring to FIG. 4A again, for the first frame period of the display period, in the enable period of PSL2, the clock signals CKG, CKB, and CKR state at the enable states successively (the first combination of the enable states for the pixel group PG2,1), the enable states of the clock signals CKG, CKB, and CKR do not overlap. At this time, the green (G), blue (B), and red (R) information of the data signal S[1] are successively provided to the sub-pixels 100_2,2, 100_2,3, and 100_2,1 in time. Referring to FIG. 4B, for the second frame period of the display period, in the enable period of PSL2, the clock signals CKR, CKB, and CKG state at the enable states successively (the second combination of the enable states for the pixel group PG2,1), the enable states of the clock signals CKR, CKB, and CKG do not overlap. At this time, the red (R), blue (B), and green (G) information of the data signal S[1] are successively provided to the sub-pixels 100_2,1, 100_2,3, and 100_2,2 in time. Similarly, referring to FIGS. 4C~4F represent, for the pixel group PG2,1, the third, fourth, fifth, and sixth combinations of the enable states of the clock signals in the third, fourth, fifth, and sixth frame periods of the display period.

According to FIGS. 4A~4F, for the pixel group PG1,1, in one display period, the pattern of the enable states of the clock signals in the second frame (the enable order is: CKG→CLB→CKR) is inverse to that in the first frame (the enable order is: CKR→CLB→CKG); the pattern of the enable states of the clock signals in the fourth frame (the enable order is: CKB→CLG→CKR) is inverse to that in the third frame (the enable order is: CKR→CLG→CKB); the pattern of the enable states of the clock signals in the sixth frame (the enable order is: CKB→CLR→CKG) is inverse to that in the fifth frame (the enable order is: CKG→CLR→CKB); Similarly, for the pixel group PG2,1, in one display period, the pattern of the enable states of the clock signals in the second frame is inverse to that in the first frame, the pattern of the enable states of the clock signals in the fourth frame is inverse to that in the third frame, and the pattern of the enable states of the clock signals in the sixth frame is inverse to that in the fifth frame.

As shown in FIG. 4A, in the first frame period of on display period, the pixel groups PG1,1 and PG2,1 receive the data signal S[1] successively in time. In other words, the sub-pixels 100_1,1, 100_1,3, and 100_1,2 of the pixel group PG1,1 receive the red, blue, and green information of the data signal S[1] successively, and then the sub-pixels 100_2,2, 100_2,3, and 100_2,1 of the pixel group PG2,1 receive the green, blue, and red information of the data signal S[1] successively. Accordingly, the enable state of the clock signal CKG corresponding to the green information keeps from the enable period of PSL1 to the enable period of PSL2. That is, in the enable period of PSL1, the each of the clock signals CKR and CKB has a falling edge, while the clock signal CKG does not have any falling edge.

Similarly, as shown in FIG. 4B, in the second frame period of on display period, the enable state of the clock signal CKR corresponding to the red information keeps from the enable period of PSL1 to the enable period of PSL2. That is, in the enable period of PSL1, the each of the clock signals CKG and CKB has a falling edge, while the clock signal CKR does not have any falling edge. In the third, fourth, fifth, and six frame periods of one display period, the clock signals CKR, CKG, and CKB have respective falling edges by using the above analogue manner, as shown in FIGS. 4C~4F.

According to the above embodiment, in the six frame of one display period, through the six combinations of the enable states of the clock signals CKR, CKG, and CKB, the number of that the red information transmitted to the pixel group PG1,1 suffers the kickback-voltage effect induced by clock signal CKR is equal to the number of that the red information transmitted to the pixel group PG2,1 suffers the kickback-voltage effect induced by clock signal CKR. For the pixel groups PG1,1 and PG2,1, the number of that each of green and blue information suffers the kickback-voltage effect induced by the clock signals also has the same result as the red information described above. Accordingly, in one display period, the display device 1 compensates for the voltage variation induced by the above kickback-voltage effect by the six combinations of the enable states of the clock signals. In other words, through the six combinations of the enable states of the clock signals, the variation in the degrees of the same color for different pixel groups is degraded, and images displayed by the display device 1 is more uniform.

Figure 5:
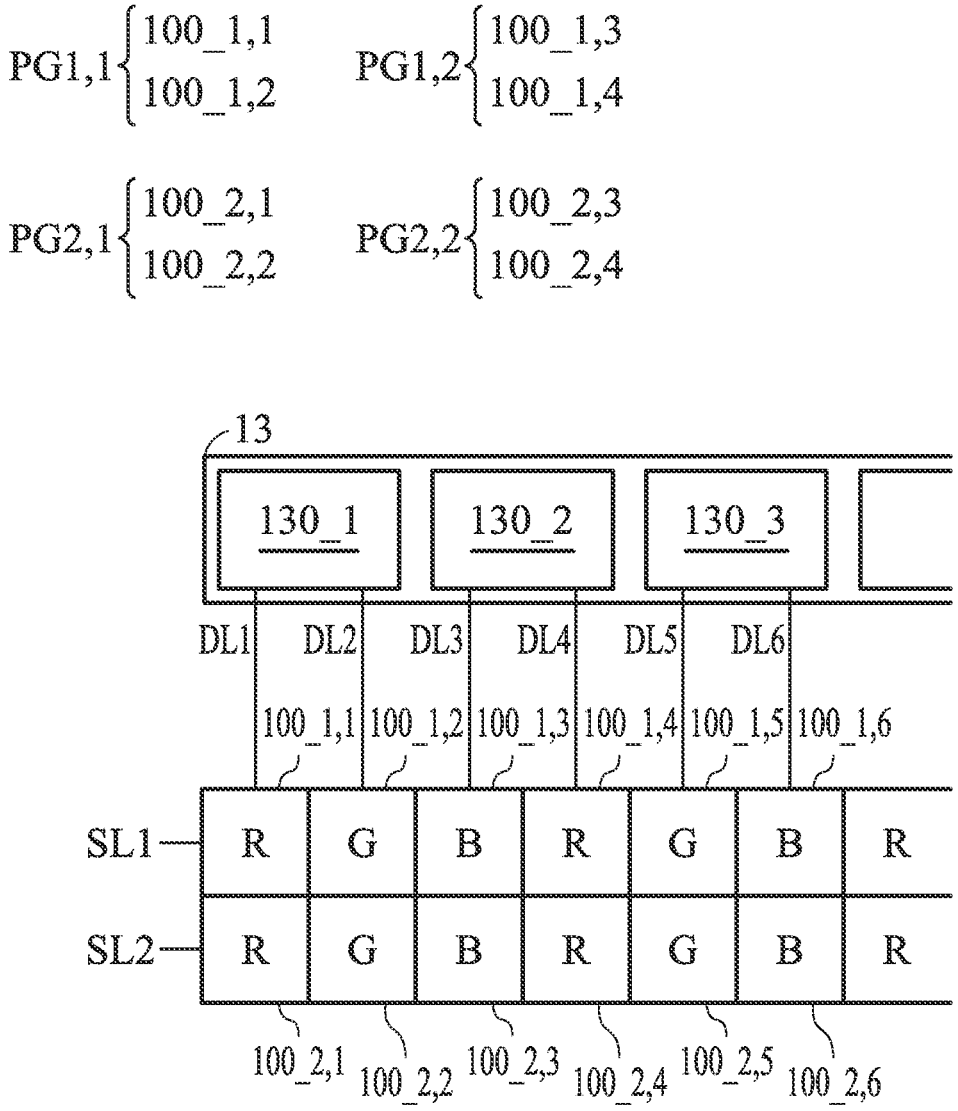
FIG. 5 shows another exemplary embodiment of switch units and pixel groups.

In another embodiment, two sub-pixels (K=2) being belonged/grouped into one pixel group are given as an example for illustrating the operation of the switch circuit 13. Referring to FIG. 5, for the scan line SL1, the first two sub-pixels 100_1,1 and 100_1,2 are belonged into a pixel group PG1,1; the following two sub-pixels 100_1,3 and 100_1,4 are belonged into a pixel group PG1,2; and the other sub-pixels are belonged into the corresponding pixel groups by the same manner. For the line SL2, the first two sub-pixels 100_2,1 and 100_2,2 are belonged into a pixel group PG2,1; the following two sub-pixels 100_2,3 and 100_2,4 are belonged into a pixel group PG2,2; and the other sub-pixels are belonged into the corresponding pixel groups by the same manner. For illustrating the relationship between the sub-pixels and pixel groups, FIG. 5 only shows the sub-pixels and the pixel groups on the scan lines SL1 and SL2. The relationship between the sub-pixels and the pixel groups on the scan lines SL3~SLn is the same as that on the scans SL1 and SL2, and the related description is thus omitted. Referring to FIG. 5, the pixel groups PG1,1 and PG2,1 are coupled to the same data lines DL1 and DL2, and the pixel groups PG1,2 and PG2,2 are coupled to the same data lines DL3 and DL4.

Similarly to the embodiment of FIG. 2, in the embodiment, the number of switch units in the switch circuit 13 is equal to the number of pixel groups on the same scan line. Accordingly, the pixel groups which are coupled to the same scan line are coupled to different switch units, and the two pixel groups which are coupled to two adjacent scan lines and the same data line are coupled to the same switch unit. The disposition between the pixel groups and the switch units are the same as that in the embodiment of FIG. 2, and, thus, the related description is omitted here.

In the embodiment of FIG. 5, the two sub-pixels in each pixel group correspond to different color information. As shown in FIG. 5, in each of the pixel groups PG1,1 and PG2,1, the sub-pixels respectively corresponding to the red (R) and green (G) information are disposed successively. In each of the pixel groups PG1,2 and PG2,2, the sub-pixels respectively corresponding to the blue (B) and red (R) information are disposed successively. For all pixel groups on one scan line, the sub-pixels respectively corresponding to the red (R), green (G), and blue (B) are disposed successively and repeatedly.

Figure 6:
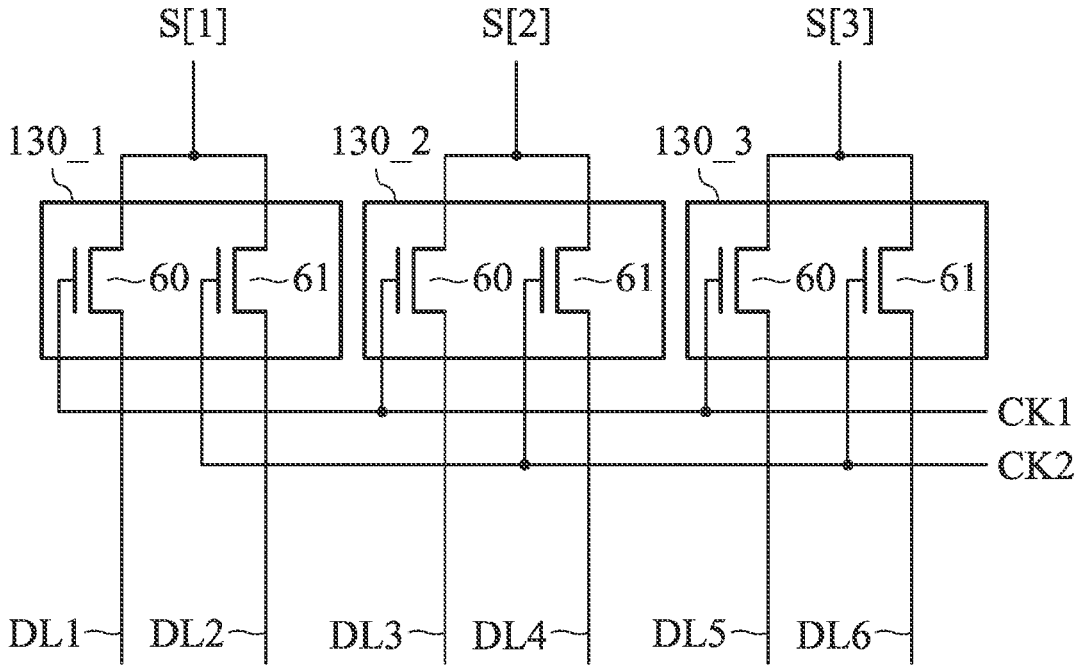
FIG. 6 shows another exemplary embodiment of a circuit structure of a switch circuit.

The display array 10 is driven by a time-division driving method called a de-multiplexer (DEMUX) driving method. Thus, the number of clock signals generated by the clock generator 14 is determined according to the number (K) of sub-pixels in each pixel group. In the embodiment of FIG. 5, the number of clock signals generated by the clock generator 14 is equal to the number of sub-pixels in each pixel group, that is the clock generator 14 generates two clock signals CK1 and CK2 (K=2) for controlling each switch unit. FIG. 6 shows an exemplary embodiment of each switch unit. Referring to FIG. 6, each switch unit comprises two switches 60 and 61 to accomplish the 1:2 DEMUX driving method. Gates of the switches 60 and 61 receive the clock signals CK1 and CK2 respectively. Drains of the switches 60 and 61 are coupled to the source driver 12. Sources of the switches 30, 31, and 32 are coupled to the corresponding data lines respectively. For example, for the switches 60 and 61 of the switch unit 130_1, the gates receive the clock signals CK1 and CK2 respectively, the drains thereof are coupled to the drain driver 12 to receive a data signal S[1], and the sources thereof are coupled to the data lines DL1 and DL2 respectively. The other switch units have the same circuitry structure as the switch unit 130_1, and the related description is thus omitted. When one clock signal is at an enable state, the corresponding switch is turned on to transmit the corresponding color information in the data signal to the corresponding data line. For example, for the switch unit 130_1, when the clock signal CK1 is at the enable state, the switch 60 is turned on to transmit the red information in the data signal S[1] to the data line DL1; when the clock signal CK2 is at the enable state, the switch 61 is turned on to transmit the green information in the data signal S[1] to the data line DL2. For the switch unit 130_2, when the clock signal CK1 is at the enable state, the switch 60 is turned on to transmit the blue information in the data signal S[2] to the data line DL3; when the clock signal CK2 is at the enable state, the switch 61 is turned on to transmit the red information in the data signal S[2] to the data line DL4. For the switch unit 130_3, when the clock signal CK1 is at the enable state, the switch 60 is turned on to transmit the green information in the data signal S[3] to the data line DL5; when the clock signal CK2 is at the enable state, the switch 61 is turned on to transmit the blue information in the data signal S[3] to the data line DL6. The operation and the relationship between the clock signals and transmission of the color information of the other switch units are the same as these of the switch units 130_1~130_3.

In an embodiment, for each pixel group, in each display period, the number of combinations of the enable states of the clock signals CK1 and CK2 is equal to 2 ($X=2\times C_2^K$ wherein K=2). Thus, each display period comprises two frame periods. For each pixel group, the two combinations of the enable states of the clock signals CK1 and CK2 appear in the two frame periods of one display period respectively.

Figure 7A:
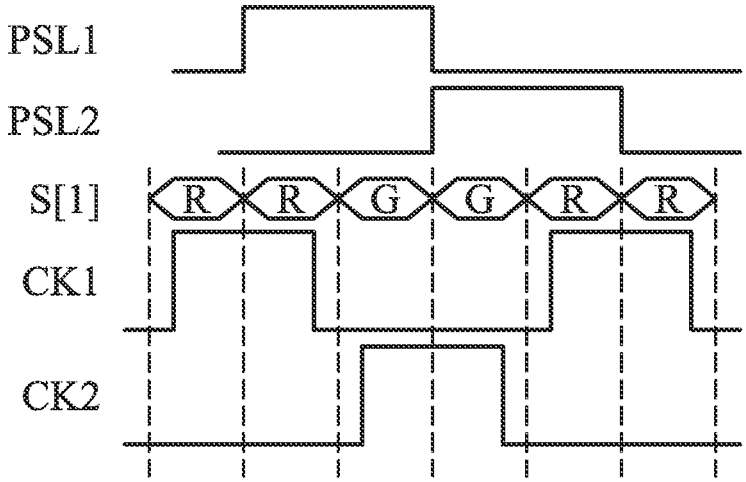
FIGS. 7A-7B show another exemplary embodiment of combinations of enable states of clock signals in the several frame periods.
Figure 7B:
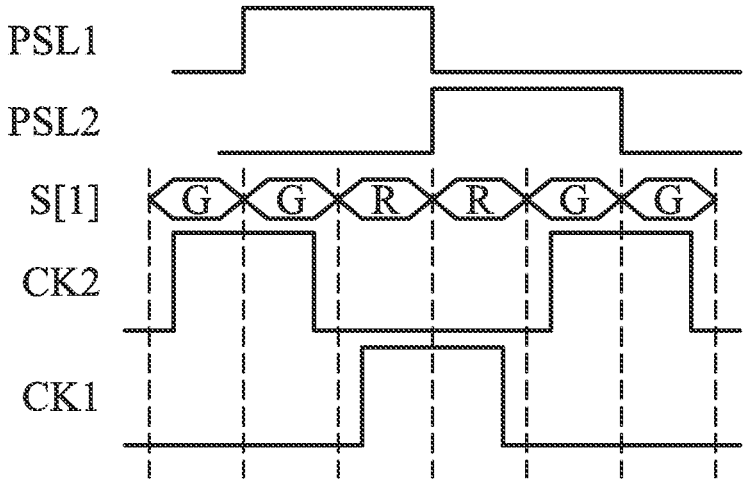

FIGS. 7A and 7B shows an exemplary embodiment of the two combinations of the enable states of the clock signals CK1 and CK2 in the two frame periods in one display period. In FIGS. 7A and 7B, PLS1 represents the timing when the pixel group PG1,1 receives the data signal S[1]. That is, in the enable period of PLS1, the switches 60 and 61 of the switch unit 130_1 are turned on to transmit the red and green information of the data signal S[1] to the sub-pixels 100_1,1 and 100_1,2 through the data lines DL1 and DL2, respectively. In FIGS. 7A and 7B, PLS2 represents the timing when the pixel group PG2,1 receives the data signal S[1]. That is, in the enable period of PLS2, the switches 60 and 61 of the switch unit 130_1 are turned on to transmit the red and green information of the data signal S[1] to the sub-pixels 100_2,1 and 100_2,2 through the data lines DL1 and DL2, respectively.

Referring to FIG. 7A, for the first frame period of the display period, in the enable period of PSL1, the clock signals CK1 and CK2 state at the enable states successively (the first combination of the enable states for the pixel group PG1,1), the enable states of the clock signals CK1 and CK2 do not overlap. At this time, the red (R) and green (G) information of the data signal S[1] are successively provided to the sub-pixels 100_1,1 and 100_1,2 in time. Referring to FIG. 7B, for the second frame period of the display period, in the enable period of PSL1, the clock signals CK2 and CK1 state at the enable states successively (the second combination of the enable states for the pixel group PG1,1), the enable states of the clock signals CK1 and CK2 do not overlap. At this time, the green (G) and red (R) information of the data signal S[1] are successively provided to the sub-pixels 100_1,2, and 100_1,1 in time.

Referring to FIG. 7A again, for the first frame period of the display period, in the enable period of PSL2, the clock signals CK2 and CK1 state at the enable states successively (the first combination of the enable states for the pixel group PG2,1), the enable states of the clock signals CK1 and CK2 do not overlap. At this time, the green (G) and red (R) information of the data signal S[1] are successively provided to the sub-pixels 100_2,2 and 100_2,1 in time. Referring to FIG. 7B, for the second frame period of the display period, in the enable period of PSL2, the clock signals CK1 and CK2 state at the enable states successively (the second combination of the enable states for the pixel group PG2,1), the enable states of the clock signals CK1 and CK2 do not overlap. At this time, the red (R) and green (G) information of the data signal S[1] are successively provided to the sub-pixels 100_2,1 and 100_2,2 in time.

According to FIGS. 7A and 7B, for the pixel group PG1,1, in one display period, the pattern of the enable states of the clock signals in the second frame (the enable order is: CK2→CL1) is inverse to that in the first frame (the enable order is: CK1→CL2). Similarly, for the pixel group PG2,1, in one display period, the patterns of the enable states of the clock signals in the first and second frames are is inverse each other.

As shown in FIG. 4A, in the first frame period of on display period, the pixel groups PG1,1 and PG2,1 receive the data signal S[1] successively in time. In other words, the sub-pixels 100_1,1 and 100_1,2 of the pixel group PG1,1 receive the red and green information of the data signal S[1] successively, and then the sub-pixels 100_2,2 and 100_2,1 of the pixel group PG2,1 receive the green and red information of the data signal S[1] successively. Accordingly, the enable state of the clock signal CK2 keeps from the enable period of PSL1 to the enable period of PSL2. That is, in the enable period of PSL1, the clock signal CK1 has a falling edge, while the clock signal CK2 does not have any falling edge.

Similarly, as shown in FIG. 7B, in the second frame period of on display period, the enable state of the clock signal CK1 keeps from the enable period of PSL1 to the enable period of PSL2. That is, in the enable period of PSL1, the clock signal CK2 has a falling edge, while the clock signal CK1 does not have any falling edge.

According to the above embodiment, in the two frame of one display period, through the two combinations of the enable states of the clock signals CK1 and CK2, the number of that the green information transmitted to the pixel group PG1,1 suffers the kickback-voltage effect induced by clock signal CK2 is equal to the number of that the green information transmitted to the pixel group PG2,1 suffers the kickback-voltage effect induced by clock signal CK2. For the pixel groups PG1,1 and PG2,1, the number of that the red information suffers the kickback-voltage effect induced by the clock signals also has the same result as the green information described above. Accordingly, in one display period, the display device 1 compensates for the voltage variation induced by the above kickback-voltage effect by the two combinations of the enable states of the clock signals. In other words, through the two combinations of the enable states of the clock signals, the variation in the degrees of the same color for different pixel groups is degraded, and images displayed by the display device 1 is more uniform.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display device operating in a plurality of display period, comprising:

a plurality of scan lines;

a plurality of data lines, interlaced with the scan lines, transmitting a plurality of data signals, wherein each data signal has various color information;

a plurality of sub-pixels, coupled to the scan lines and the data lines, each sub-pixel corresponding to one color information; and a plurality of clock signals corresponding to the sub-pixels respectively, wherein on a same scan line, the sub-pixels with a predetermined number are belonged into a pixel group, the sub-pixels of each pixel group receives one of the data signals according to enable states of the clock signals with the predetermined number, respectively, wherein for two pixel groups coupled to same data lines and respectively coupled to two adjacent scan lines, the two pixel groups receive one of the data signals through the same data lines successively, two sub-pixels, which are respectively belonged into the two pixel groups and successively receive the one of the data signals in time, receive same one of the various color information, wherein for each pixel group, in each display period, the enable states of the clock signals have a plurality of combinations having a specific number, the specific number is $2\times C_2^K$ where $C_2^K$ represents the number of combinations for any two clock signals selected from the clock signals having the predetermined number, and K represents the predetermined number and is a positive integer, and wherein the combinations having the specific number at least comprise a first combination and a second combination following the first combination, an enable order of the clock signals in the second combination is inverse to an enable order of the clock signals in the first combination.

2. The display device as claimed in claim 1, wherein each display period comprises a plurality of frame periods having the specific number, and each frame period corresponds to one of the combination of the enable states having the specific number.

3. The display device as claimed in claim 1, wherein the specific number is equal to or greater than two.

4. The display device as claimed in claim 1, wherein in each pixel groups, the sub-pixels receive different color information in the corresponding data signal.

5. The display device as claimed in claim 1, further comprising:

a switch circuit, coupled to the data lines, comprising a plurality of switch coupled to the data lines and receiving the data signals, respectively;

wherein for each pixel group, corresponding switches are controlled by the clock signals having the predetermined number to transmit the corresponding data to the corresponding data lines.

6. A display device operating in a plurality of display period, comprising:

a plurality of scan lines;

a plurality of data lines, interlaced with the scan lines, transmitting a plurality of data signals, wherein each data signal has various color information;

a plurality of sub-pixels, coupled to the scan lines and the data lines, each sub-pixel corresponding to one color information; and a plurality of clock signals corresponding to the sub-pixels respectively, wherein on a same scan line, the sub-pixels having a predetermined number are belonged into a pixel group, the sub-pixels of each pixel group receives one of the data signals according to enable states of the clock signals with the predetermined number, respectively, wherein for two pixel groups coupled to same data lines and respectively coupled to two adjacent scan lines, the two pixel groups receive one of the data signals through the same data lines successively, two sub-pixels, which are respectively belonged into the two pixel groups and successively receive the one of the data signals in time, receive same one of the various color information, wherein for the two pixel groups coupled to the same data lines and respectively coupled to the two adjacent scan lines, in each display period, a number of occurrences of kickback-voltage effect induced by corresponding clock signals during a first period when one of the two pixel groups receives the one of the data signals is equal to a number of occurrences of kickback-voltage effect induced by the corresponding clock signals during a second period when the other of the two pixel groups receives the one of the data signal, and wherein for each pixel group, combinations with a specific number at least comprise a first combination and a second combination following the first combination, an enable order of the clock signals in the second combination is inverse to an enable order of the clock signals in the first combination.

7. The display device as claimed in claim 6, wherein for the two pixel groups coupled to the same data lines and respectively coupled to the two adjacent scan lines, in each display period, a number of occurrences of falling edges of one of the clock signals during the first period is equal to a number of occurrences of falling edges of the one of the clock signals during the second period.

8. The display device as claimed in claim 6, wherein the specific number is equal to or greater than two.

9. The display device as claimed in claim 6, wherein in each pixel groups, the sub-pixels receive different color information in the corresponding data signal.

10. The display device as claimed in claim 6, further comprising:

a switch circuit, coupled to the data lines, comprising a plurality of switch coupled to the data lines and receiving the data signals, respectively;

wherein for each pixel group, corresponding switches are controlled by the clock signals with the predetermined number to transmit the corresponding data to the corresponding data lines.

* * * * *